United States Patent [19]

Kamiya et al.

[11] Patent Number: 4,483,485

[45] Date of Patent: Nov. 20, 1984

[54] ELECTROMAGNETIC FUEL INJECTOR

[75] Inventors: Kingo Kamiya, Toyoake; Takaaki Takagi, Obu, both of Japan

[73] Assignee: Aisan Kogyo kabuskiki Kaisha, Obu, Japan

[21] Appl. No.: 443,571

[22] Filed: Nov. 22, 1982

[30] Foreign Application Priority Data

Dec. 11, 1981 [JP] Japan ..... 56-185081[U]
Dec. 14, 1981 [JP] Japan ..... 56-203066

[51] Int. Cl.[3] ..... B05B 1/30

[52] U.S. Cl. ..... 239/585; 251/139; 251/333; 251/356

[58] Field of Search ..... 239/585; 251/139, 140, 251/333, 356

[56] References Cited

U.S. PATENT DOCUMENTS 4,313,571 2/1982 Bellicardi et al. ..... 239/585
4,403,741 9/1983 Moriya et al. ..... 239/585

*Primary Examiner*—Andres Kashnikow

*Assistant Examiner*—Mary F. McCarthy

*Attorney, Agent, or Firm*—Dennison, Meserole, Pollack & Scheiner

[57] ABSTRACT

An electromagnetic fuel injector comprising a valve body composed of a spherical valve member and a hollow cylindrical slide member which is adapted to slide along a guide hole and the interior of which is a fuel passage. The slide member is provided with openings for passing liquid fuel therethrough at its peripheral wall. A circumferential clearance ranging from 4 to 30 $\mu$ is provided between the outer surface of the slide member and the inner surface of the guide hole. At least one of the valve member and the slide member which members constitute the valve body is formed of titanium, titanium alloy, ceramic or ferric material. With this arrangement, the slide member may be fabricated without a strictly high accuracy and the mass of the valve body may be reduced, thus increasing the response characteristics of the valve body to the on-off operation of an exciting coil.

7 Claims, 10 Drawing Figures

ELECTROMAGNETIC FUEL INJECTOR

BACKGROUND OF THE INVENTION

This invention relates to an electromagnetic fuel injector for use in an electronically controlled fuel injection system of a single- or multiple-point type for an internal combustion engine in an automotive vehicle.

FIG. 1 shows a vertical sectional view of a conventional electromagnetic fuel injector designated by reference numeral 1. The electromagnetic fuel injector 1 is provided with a fuel injection nozzel 3 at its front end. A valve housing 2 is provided with a fuel passage 4 extending along its axis, and a plunger-like valve body 5 is inserted into the fuel passage 4. An armature 6 is fixed to the rear end of the valve body 5. The valve housing 2 is retained by an electromagnetic housing 7 at its front portion. A fixed magnet core 8 and an exciting coil or winding 9 are accomodated in the electromagnetic housing 7 at its rear portion. In response to the control signal inputted from a terminal 10 to the exciting coil 9, the valve body 5 is effective to axially reciprocate for discharging pressurized liquid fuel from the fuel injection nozzle 3. FIG. 2 shows an enlarged sectional view of the fuel injection nozzle 3 in FIG. 1. As may be seen, the inner surface of the nozzle 3 serves as a valve seat 3*a* which is adapted to come into contact with a valve member 5*a* of the valve body 5. The cylindrical inner surface of the fuel passage 4 serves to guide a slide portion of the valve body 5. The front portion of the valve housing 2 is protected by a cover 7*a* and the rear portion thereof is fixed to the front portion of the electromagnetic housing 7 with an O-ring seal 11 and a spacer 12 interposed. The valve member 5*a* is provided with a pintle 19 at its front end, and the pintle 19 is formed with a conical tip 19*a* at its front end. The outer circumference of the valve body 5 is formed with a flange 5*b* on the front side of the spacer 12, and the flange 5*b* is adapted to come into contact with the front surface of the spacer 12 when the valve body 5 moves up to the rearmost position. The electromagnetic housing 7 as a yoke is formed of a ferromagnetic material, and the exciting coil 9 is housed in a space between the electromagnetic housing 7 and the fixed magnet core 8 with O-ring seals 13 and 14 interposed. The fixed magnet core 8 is also formed of a ferromagnetic material and is provided with an axial through-hole as a fuel passage 15. A compression spring 16 is inserted into the front portion of the axial through-hole so as to normally bias against the rear end of the armature 6 and hold the valve body 5 in a closed position. The compression spring 16 abuts against the front end of a sleeve 17 which is carried in the axial through-hole of the fixed magnet core 8. A fuel filter 18 is provided at the rear end of the fuel passage 15.

In such an electromagnetic fuel injector 1, it is necessary for the valve body 5 to smoothly reciprocate and to seal the pressurized fuel with the valve member tightly contacted to the valve seat 3*a* in its closed position. For this purpose, it is required to fabricate the front and the rear slide portions of the valve body 5 and the guide hole 4 with a high degree of accuracy. Accordingly, the valve seat 3*a* and the valve member 5*a* are required to have a strictly limited surface roughness, roundness and axial concentricity thereof. The foremost end of the valve body 5 including the pintle 19 and its contical tip 19*a* needs to be formed in complicated shape so as to atomize the liquid fuel supplied to the fuel injection nozzle 3. Furthermore, the guide hole 4 and the valve body 5 are formed of stainless steel, thus rendering the fabrication of such elements more difficult and more costly.

Since the total weight of the valve body 5 and the armature 6 is relatively large, say about 5 grams, the response of the valve body 5 to the on-off operation of the exciting coil 9 is not satisfactory and the valve body 5 is likely to wear because of large impact force. For purposes of stabilization of idle engine speed and reduction in fuel consumption, it is necessary to shorten the time required for the valve body 5 to be stabilized when the valve is opened or closed.

To this end, the mass of the valve body 5 and the armature 6 may be reduced, but the diameter of the valve body 5 may not be so reduced in order that a high degree of accuracy of the slide portion he retained. To prevent a large inclination of the axis of the valve body 5 relative to the axis of the guide hole 4, the axial length of the valve body 5 may not be so shortened. Because of the above-mentioned problem, it has been considered to be difficult to establish an electromagnetic fuel injector wherein its valve body is quick in response and has good wear-resistance.

To solve such a problem, the prior art has proposed a valve structure of an electromagnetic fuel injector wherein either a valve seat or a valve member has a spherical surface, so as to allow machining accuracy of valve elements to be reduced and to greatly improve fuel injection performance and durability of a fuel injection valve with a simple structure of the valve elements and with a remarkably reduced productive cost.

SUMMARY OF THE INVENTION

Accordingly, it is a primary object of the present invention to provide an electromagnetic fuel injector having a valve body composed of a spherical valve member and a hollow cylindrical slide member.

It is another object of the present invention to provide an electromagnetic fuel injector which may meter fuel with a high degree of accuracy from low-speed to high-speed operation and stabilize idle engine speed to reduce fuel consumption.

It is a further object of the present invention to provide an electromagnetic fuel injector in which an optimal circumferential clearance is defined between the slide member of the valve body and the guide hole for the slide member, so as to exhibit self-aligning function.

According to the present invention, an electromagnetic fuel injector includes a valve body composed of a spherical valve member and a hollow cylindrical slide member which is adapted to slide along a guide hole and the interior of which is a fuel passage. The slide member is provided with openings for passing liquid fuel therethrough at its peripheral wall. A circumferential clearance ranging from 4 to 30$\mu$ is provided between the outer surface of the slide member and the inner surface of the guide hole. At least one of the valve member and the slide member which constitute the valve body is formed of titanium, titanium alloy, ceramic or ferric material. With this arrangement, the slide member may be fabricated without calling for strictly high degree of accuracy and the mass of the valve body may be reduced, thereby increasing the response characteristic of the valve body to the on-off operation of the exciting coil. In other words, the responsive action of the valve body is quick when the valve is opened or closed, and the time required for the valve body to be stabilized may be shortened.

Various general and specific objects, advantages and aspects of the invention will become apparent when reference is made to the following detailed description of the invention considered in conjunction with the related accompanying drawings.

DETAILED DESCRIPTION OF THE PREFERRED EMBODIMENTS

Figure 1:
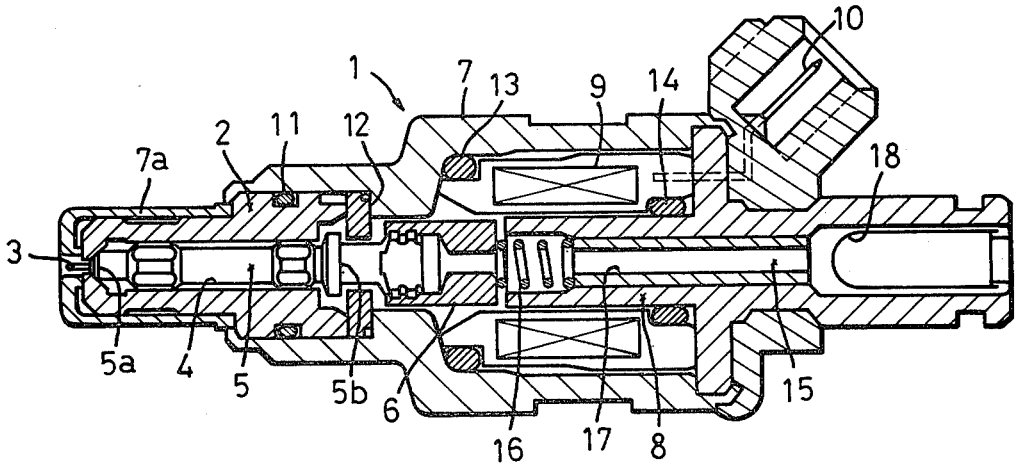
FIG. 1 is a vertical cross-sectional view of a conventional electromagnetic fuel injector.
Figure 2:
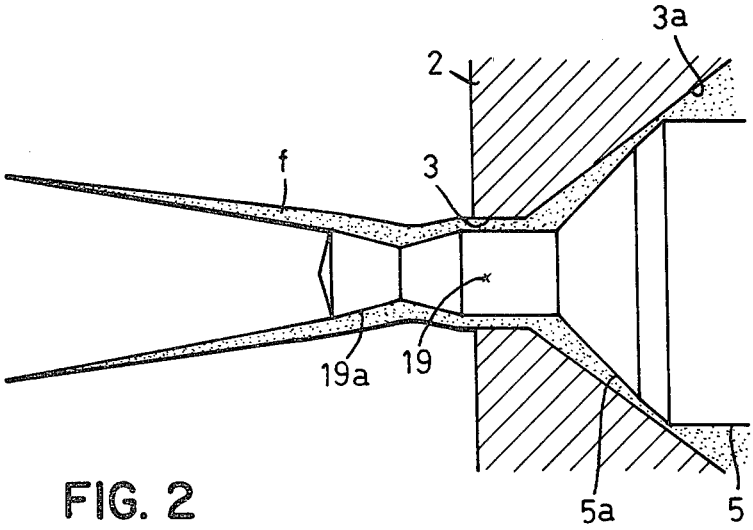
FIG. 2 is an enlarged view of the fuel injection nozzle of the electromagnetic fuel injector in FIG. 1.
Figure 3:
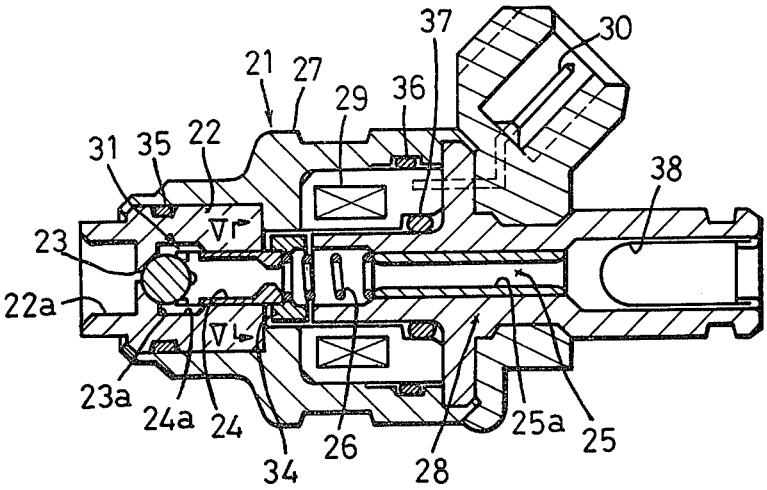
FIG. 3 is a vertical cross-sectional view of an electromagnetic fuel injector according to the present invention.

Referring now to FIG. 3, reference numeral 21 generally designates an electromagnetic fuel injector having a valve housing 22 provided with a fuel injection nozzle 23 at its front end and a guide hole 24 extending along its axis for guiding a plunger-like valve body 31. The valve body 31 is slidably inserted into the guide hole 24. An armature 34 is fixed to the rear end of the valve body 31. A fuel chamber **24*a* is defined between the fuel injection nozzle 23 and the front portion of the guide hole 24. Arrangements of electromagnetic housing 27, fixed magnet core 28, exciting coil 29, terminal 30, O-ring seals 35, 36 and 37, and fuel filter 38 are substantially identical with those in a conventional electromagnetic fuel injector. The fixed magnet core 28 is provided with an axial through-hole as a fuel passage 25. A compression spring 26 is inserted into the front portion of the axial through-hole so as to normally bias against the rear end of the valve body 31 and hold the valve body 31 in a closed position. The compression spring 26 abuts against the front end of a sleeve 25*a* which is carried in the axial through-hole of the fixed magnet core 28**.

Figure 5:
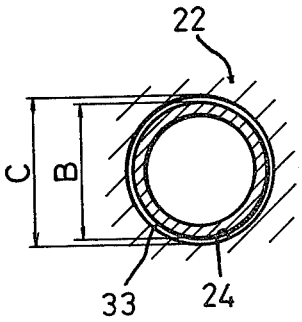
FIG. 5 is an enlarged cross-sectional view taken along the line V—V in FIG. 3.
Figure 4:
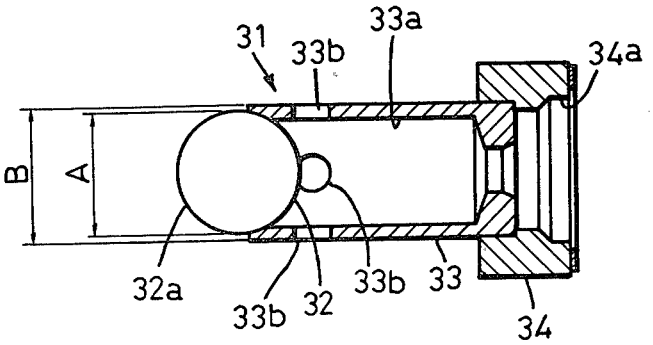
FIG. 4 is an enlarged view of the valve body of the electromagnetic fuel injector in FIG. 3.

As shown in FIG. 4, the valve body 31 is constituted of a valve member 32 having a spherical surface **32*a*, hollow cylindrical slide member 33 and an armature 34 fixed on the rear end of the slide member 33. The interior of the slide member 33 serves as a fuel passage 33*a* and fuel outlets 33*b* are provided at the front side wall of the slide member 33. With this arrangement, liquid fuel flowing through an opening 34*a* of the armature 34 is supplied through the fuel passage 33*a* and the fuel outputs 33*b* to the fuel chamber 24*a*. Outside diameter A of the valve member 32 is determined to be smaller than outside diameter B of the slide member 33, so as for the valve member 32 not to interfere with the guide hole 24 during reciprocating motion of the valve body 31. Clearance (C−B) between outside diameter B of the slide member 33 and inside diameter C of the guide hole 24 is set to the range of 4 to 30 $\mu$ (See FIG. 5**).

Figure 6:
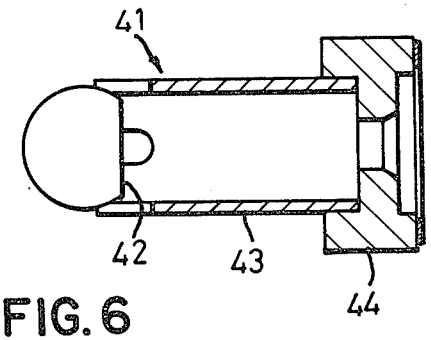
FIGS. 6 to 10 are vertical cross-sectional views of other embodiments according to the present invention.
Figure 7:
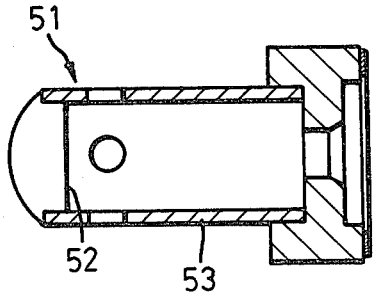
Figure 8:
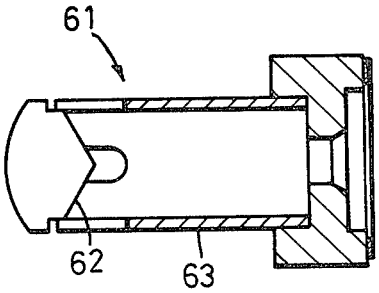

FIGS. 6 through 8 show other embodiments of the valve body. Reference numerals 41, 51 and 61 are valve bodies in each embodiment, which valve bodies are constituted of valve members 42, 52 and 62 and slide members 43, 53 and 63, respectively.

In order to reduce the weight of the valve body 31, 41, 51 and 61, the valve members 32, 42, 52 and 62 and/or the slide members 33, 43, 53 and 63 are preferably formed of titanium or titanium alloy having specific gravity of about 4.5 as well as stainless steel SUS 440C having specific gravity of about 8.0 or more preferably formed of ceramic having specific gravity of about 2 to 4. As is similar to the first preferred embodiment, clearance between each outer diameter of the slide members of the valve bodies 41, 51 and 61 and each inner diameter of the guide holes is set to the range of 4 to 30$\mu$.

Figure 9:
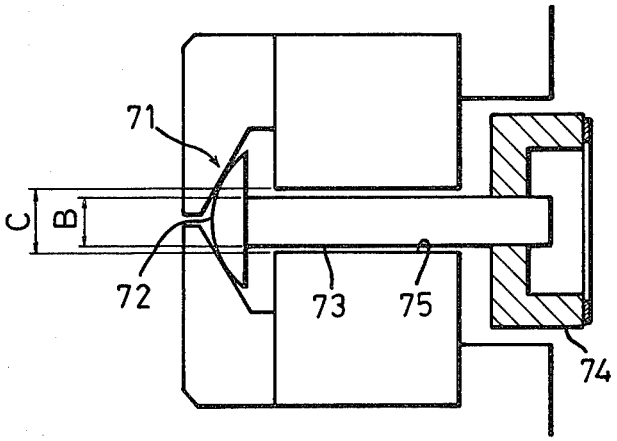
Figure 10:
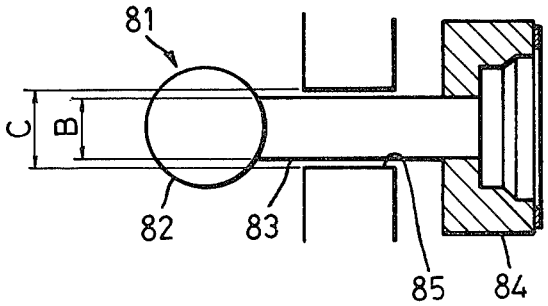

FIGS. 9 and 10 are other embodiments of the valve body. Reference numerals 71 and 81 are valve bodies in each embodiment, which valve bodies are constituted of valve members 72 and 82 having spherical surfaces, a rod-like slide members 73 and 83 having outer diameters smaller than the maximum outer diameter of the valve members and armatures 74 and 84, respectively. In these embodiments, clearance (C−B) between each outer diameter B of the slide members 73 and 83 and each inner diameter C of the guide holes 75 and 85 is also set to the range of 4 to 30$\mu$.

In operation of the electromagnetic fuel injector 21, the pressurized fuel is supplied from the fuel filter 38 through the fuel passages 25, **34*a* and 33*a* and the fuel outlets 33*b* to the fuel chamber 24*a*. Since the valve body 31 is normally biased by the compression spring 26, the fuel injection nozzle 23 is closed in the normal position of the valve body 31. When control signal to open the valve body is inputted from a computer (not shown) to the exciting coil 29, magnetic field is generated at the electromagnetic housing 27 and the fixed magnet core 28 and as the result, the armature 34 and the valve body 31 are rearwardly attracted. Accordingly, clearance is created between the valve seat 23*a* and the spherical surface 32*a* of the valve member 32 and the pressurized fuel in the fuel chamber 24*a* is discharged from the fuel injection nozzle 23**.

Since there is preferably provided clearance ranging 4 to 30$\mu$ between the outside surface of the slide member 33 and the inside surface of the guide hole 24, and the valve member 32 has a spherical surface **32*a*, even if both axes of the guide hole 24 and the slide member 33 are slightly out of alignment, the spherical surface 32*a* of the valve member 32 comes to peripheral contact with the conical surface of the valve seat 32*a* to achieve a substantially complete sealing operation. The clearance ranging 4 to 30$\mu$ is experimentally obtained and it is appreciated that the operation of the valve body 31 is stable within this range and a self-aligning function of the valve body is satisfactorily effected, thereby permitting the length of the slide member 33** to be smaller than that of a conventional valve body and the weight of the valve body to be reduced.

Since the slide member 33 is of a hollow cylindrical shape and the valve member 32 and the slide member 33 are formed of a light material such as titanium, the valve body 31 is reduced in weight, thereby increasing the response characteristic to the on-off operation of the exciting coil and reducing the time required for the valve body to be stabilized when the valve is opened or closed.

In operation of the valve bodies 41, 51 and 61, since there is provided clearance ranging 4 to 30$\mu$ between the outside surface of the slide member and the inside surface of the guide hole, the spherical valve members 42, 52 and 62 may effect satisfactory self-aligning function, thereby permitting the length of the slide member to be reduced. Furthermore, a hollow cylindrical shape of the slide member and a light material such as titanium of the slide member and/or the valve member permit the valve body to be reduced in weight and improve the response characteristic to the on-off operation of the exciting coil.

In operation of the valve bodies 71 and 81, the outside diameters of the slide members 73 and 83 are reduced so as to lighten the valve bodies. As is similar to the preceding embodiments, since there is provided clearance ranging 4 to 30μ between the outside surface of the slide member and the inside surface of the guide hole, the spherical valve members 72 and 82 may effect satisfactory self-aligning function, thereby permitting the length of the slide members 73 and 83 to be reduced. This results in reduction in weight of the valve body and in improvement of the response characteristic to the on-off operation of the exciting coil 29.

Having thus described the preferred embodiment of the invention it should be understood that numerous structural modifications and adaptations may be restored to without departing from the spirit of the invention.

What is claimed is:

1. In an electromagnetic fuel injector including:

a valve housing provided with a fuel injection nozzle and a valve seat at its front end and defining a guide hole extending along the axis of said valve housing, a valve body slidably inserted into said guide hole, a compression spring adapted to normally urge said valve body so as to close said fuel injection nozzle, an armature fixed to the rear end of said valve body, a fixed magnet core disposed opposite to the rear end of said armature and having a fuel passage extending through the central portion of said core, an exciting coil surrounding said fixed magnet core, and an electromagnetic housing combining said valve housing with said fixed magnet core, said electromagnetic fuel injector being adapted to discharge pressurized fuel when said exciting coil receives a control signal to open said valve body, the improvement wherein said valve body comprises a spherical valve member and a hollow cylindrical slide member integral with said valve member which is adapted to slide along said guide hole and the interior of which hollow slide member is a fuel passage, said slide member defining openings at its front and rear ends for passing liquid fuel therethrough, the outer diameter of said slide member being at all points less than the diameter of said hole and the outer diameter of said spherical valve member being less than the outer diameter of said slide member, and said armature being substantially of a hollow cylindrical cross-section of inner diameter greater than the diameter of said compression spring, whereby said compression spring applies force directly to said valve body.

2. The electromagnetic fuel injector as defined in claim 1 wherein both said valve member and said slide member are formed of titanium, a titanium alloy, a ceramic or a ferric material.

3. The electromagnetic fuel injector as defined in claim 1 wherein said valve member is formed of titanium or a titanium alloy and said slide member is formed of a ceramic.

4. The electromagnetic fuel injector as defined in claim 1 wherein said valve member is formed of a ceramic and said slide member is formed of titanium or a titanium alloy.

5. The electromagnetic fuel injector as defined in claim 1 wherein said valve member is formed of titanium, a titanium alloy or a ceramic and said slide member is formed of a ferric material.

6. The electromagnetic fuel injector as defined in claim 1 wherein said valve member is formed of a ferric material and said slide member is formed of titanium, a titanium alloy or a ceramic.

7. The electromagnetic fuel injector as defined in any one of claims 1 to 6 wherein a circumferential clearance ranging from 4 to 30μ is provided between the outer surface of said slide member and the inner surface of said guide hole.

* * * * *